United States Patent [19]

Lambert, Jr.

[11] 4,236,712

[45] Dec. 2, 1980

[54] STANDING CALF EXERCISE MACHINE

[76] Inventor: Lloyd J. Lambert, Jr., c/o President, Dynamics Health Equipment Manufacturing Co., Inc., 1538 College Ave., South Houston, Tex. 77587

[21] Appl. No.: 7,959

[22] Filed: Jan. 31, 1979

[51] Int. Cl.[3] ..... A63B 21/06

[52] U.S. Cl. ..... 272/118; 272/143

[58] Field of Search ..... 272/118, 117, 138, 136, 272/142, 143, DIG. 4, 130

[56] References Cited

U.S. PATENT DOCUMENTS 3,917,262 11/1975 Salkeld ..... 272/118

FOREIGN PATENT DOCUMENTS 405617 4/1967 United Kingdom ..... 272/130

OTHER PUBLICATIONS

"Deluxe and Hacke", Marcy Gym Equipment Co., Catalogue No. 71, p. 60.

*Primary Examiner*—Richard C. Pinkham
*Assistant Examiner*—William R. Browne
*Attorney, Agent, or Firm*—Victor J. Evans & Co.

[57] ABSTRACT

An apparatus for exercising the calf muscles defined by a framework in which a top extremity thereof is provided with a pair of horizontally extending arms pivoted to a pair of top frame members interconnected and capable of rotation, shoulder pads disposed on the bottom face of these rods at extremities remote from the pivot point, a rigidifying cross brace provided with an opening through which a vertically extending rod is adjustably pinned. This rod traverses through a plurality of weights whose magnitude is selectable and substantially beneath the shoulder pads there is provided on the floor a toe support so that one's toes while standing thereon allows the heel to extend out into space. The exercise is performed by flexing the arch and standing on one's toes which provides tension to the calf muscle.

5 Claims, 2 Drawing Figures

FIG 1
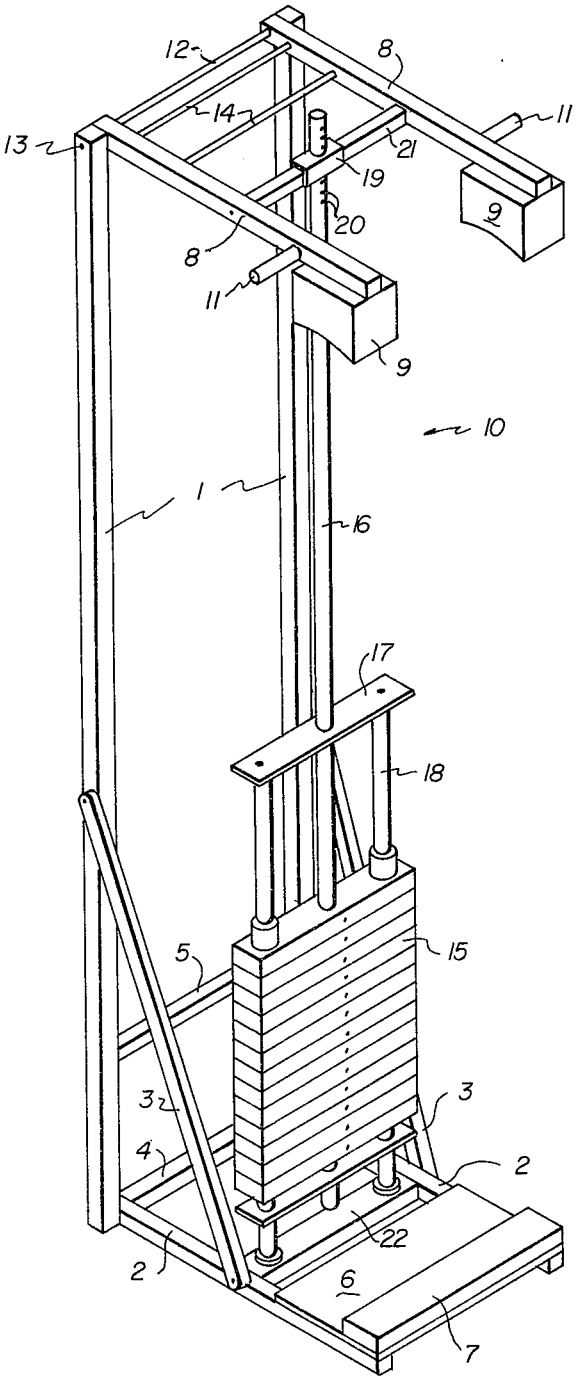
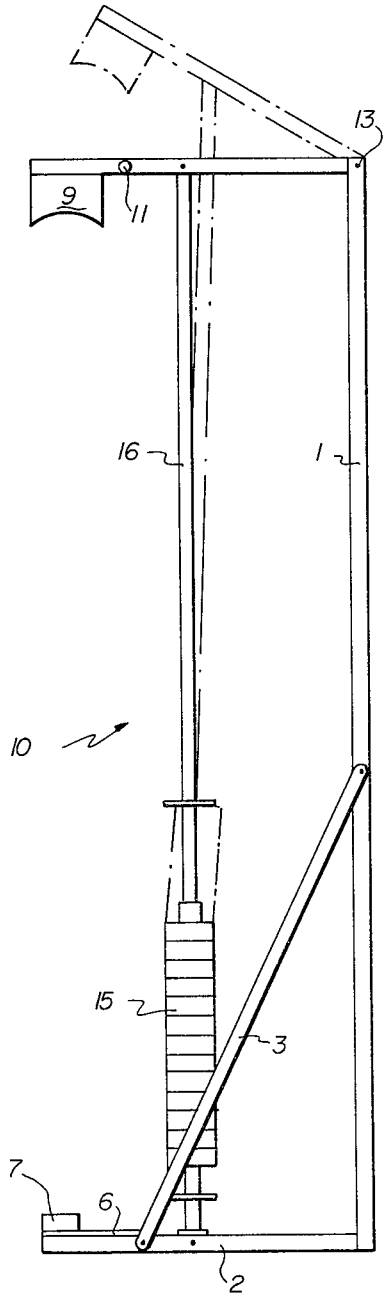
FIG 2

STANDING CALF EXERCISE MACHINE

BACKGROUND OF THE INVENTION

Prior art devices which are fashioned to exclusively develop the calf muscle of an individual have been totally inadequate as far as the safety requirements concerning the user. Specifically a calf developing exercise would entail lifting a bar bell usually provided on a shoulder high stand away from the support rack and thereafter doing toe raising exercises which will provide the required benefits. It should be apparant however that should a muscle cramp or loss of balance by the exercises occur, there is no immediate safe way of removing the bar bell from off of a persons shoulder to relieve the user of the weight burden and consequently the possibility of injury in excess of the cramp, muscle tear, loss of balance etc. could compound the likely hood of an injury.

SUMMARY OF THE INVENTION

Accordingly, the ensuing specification and drawings contemplate providing an apparatus for allowing an exercisor a safe means for performing a calf exercise.

A further object of this invention comprises providing an apparatus in which the amount of work to be done is variable as a function of the magnitude of the weights selected.

A further object includes providing a machine which is durable in construction and relatively easy to use.

These and other objects will be made manifest when considering the following detailed specification and drawings.

BRIEF DESCRIPTION OF THE DRAWINGS

FIG. 1 is an isometric view of the apparatus according to the present invention; and FIG. 2 is a side view thereof.

DESCRIPTION OF THE PREFERRED EMBODIMENT

Referring to the drawings now, wherein like reference numerals refer to like parts throughout the several drawings, reference numeral 10 is directed to the standing calf exercise machine according to the present invention.

The apparatus may be considered as having a rectangular base framework defined by parallel base members 2, and orthoganal support bar 4 at one extremity thereof, and a support plate 6 disposed on the top faces of the base members at the extremities remote from cross bar 4. Disposed on the support plate 6 is a toe pad 7, its purpose will be defined during the course of this description.

Extending up from the cross bar and base member intersection 2 and 4, there is provided a pair of opposed vertically upstanding rod members 1 each of which is provided with a diagonal brace 3 extending from the vertical rod to the horizontal base members 2.

The top terminus of the vertical rods 1 is provided with a pivotable shaft 12 and is pivoted through pin elements 13 integral therewith. Supporting on this shaft 12 and extending in the same horizontal direction as the toe pad are a pair of parallel elongate bar members 8 which serve to support downwardly depending shoulder pads 9 having an arcuate bottom face. The shaft 12 is supplemented to assure proper support for these members 8 by additional rods 14 and 21 which parallel rod 12 can serve to rigidify these two elongate rod members 8. Rod 21 however serves an alternative function as will now be defined. Centrally disposed on this rod is an opening which permits a vertical cylindrical rod member 16 to be disposed therethrough. A square sleeve 19 overlying this section of rod 21 is similarily provided with holes to register with holes in rod 16. A locking pin element is caused to traverse through these holes in registry with the holes 20 of vertical rod 16 thereby changing the angulation of horizontal members 8 relative to its rods 16. This modification of course will allow people of various heights to utilize the machine. Disposed between the cross bar 21 and the shoulder pads 9 are handle members 11 disposed on opposed faces of the horizontal members 8 to provide a grasping area when adjusting rod 16, and also to initialize the exercise as will be defined hereinafter.

Rod 16 terminates in a plurality of weights 15 as shown in the figures, and prior to traversing through these weights 15, the rod extends through a cross bar 17 preferably made of flat stock, which in turn supports the top extremities of cylindrical rod members 18 which are disposed at opposed extremities of the flat bar 17. The opposed terminal portions of these cylindrical rods 18 are fastened to the base framework forming a weight cage so that they are not capable of vertical displacement, but it should be seen that since the weights 15 are threaded thereon, they will support and serve as guide elements for the weights in their vertical translation, since the rod 16 is provided with openings at the bottom of its extant and they are caused to register with similar holes on the weights and by the judicious selection thereof through use of a pin, the weights can be modified in magnitude to accomodate different demands from different users. The cross brace which supports the rod members 18 at their lower most extremity bears the legend 22 and cross brace 22 terminates at bars 2—2 as shown in the Figures.

To summarize therefore an appropriate weight is selected, the user adjusts the top portion of the apparatus to accomodate his height, the pads 9 are placed on the shoulders, the toes on the pad 7, and the toe raises are performed to develop the calf muscle.

Having thus described the invention it should be apparant that the sudden release of weight, for example when caused by a cramp in the muscle, relative imbalance, etc. will cause the weights to merely go back to their rest position and not in any way aggrivate that which caused the exercisor to abandon use of the machine. It should be further apparant that the foregoing is merely illustrative and numerous structural modifications are contemplated as being a part of this invention as set forth hereinabove and as defined hereinbelow by the claims.

What is claimed is:

1. A standing calf machine comprising a base framework, a pair of vertically upstanding rod members extending from and supported by one end of said base framework, a pivotable shaft extending between termini of said rod members remote from said base framework, a pair of elongate parallel bar members extending over said base framework and attached to said pivotable shaft and having downwardly depending shoulder pads remote from said pivotable shaft, a rod extending between said bar members between said shoulder pads and said pivotable shaft, a cylindrical rod member slideably extending downwardly therethrough and provided with means for selectively fastening said last mentioned rod together, said cylindrical rod member terminating in a weight stack having holes therethrough complemental with holes on said cylindrical rod member whereby insertion of a pin therethrough selects the magnitude of weight to be used, said weights constrained in a weight cage defined by upper and lower cross bars transverse to said cylindrical rod member which slideably extends therethrough, said cross bars interconnected at extremities thereof by a pair of cylindrical rods spaced from, shorter than, and parallel to said cylindrical rod member, said lower cross bar affixed to said base framework.

2. The device of claim 1 wherein said means for selective fastening comprise an apertured sleeve, holes in a top portion of said cylindrical rod member which passes through said apertured sleeve which overlies said rod(21) whereby a pin extending therethrough can alter the height of said shoulder pads.

3. The device of claim 2 including handle members disposed on outer faces of said elongate parallel bar members to assist in height adjustment.

4. The device of claim 3 including a toe pad on said base framework remote from said vertically upstanding rod members to give purchase for the calf exercise.

5. The device of claim 4 including diagonal braces extending from said base framework to said vertically upstanding rod members.

* * * * *